US009149402B2

(12) United States Patent
Gil Gomez et al.

(10) Patent No.: US 9,149,402 B2
(45) Date of Patent: Oct. 6, 2015

(54) COVER FOR PATIENT TRANSFER DEVICES

(75) Inventors: Michael Alberto Gil Gomez, Atlanta, GA (US); Michelle R. Wilson, Caledonia, MS (US); Matthew S. Heinrich, Seattle, WA (US); Shelly Brackett, Eugene, OR (US)

(73) Assignee: Ecolab USA Inc., Eagan, MN (US)

( * ) Notice: Subject to any disclaimer, the term of this patent is extended or adjusted under 35 U.S.C. 154(b) by 207 days.

(21) Appl. No.: 13/210,621

(22) Filed: Aug. 16, 2011

(65) Prior Publication Data

US 2013/0042409 A1 Feb. 21, 2013

(51) Int. Cl.
*A61G 7/10* (2006.01)
*A47G 9/02* (2006.01)

(52) U.S. Cl.
CPC ..... *A61G 7/1028* (2013.01); *A47G 9/0246* (2013.01); *A61G 7/1063* (2013.01)

(58) Field of Classification Search
CPC . A61G 7/1028; A61G 7/1063; A61G 7/0504; A61G 1/044; A61G 7/1026; A47G 9/0246; A47C 27/008; A47C 27/007; A47C 31/08
USPC ..... 5/484, 486, 487, 489, 490, 491, 492, 5/737, 738, 703
See application file for complete search history.

(56) References Cited

U.S. PATENT DOCUMENTS

| | | | | | |
|---|---|---|---|---|---|
| 2,630,587 | A | * | 3/1953 | Brown | 5/496 |
| 3,325,832 | A | * | 6/1967 | Malicki | 5/487 |
| 3,893,198 | A | | 7/1975 | Blair | |
| 3,914,811 | A | | 10/1975 | Francis | |
| 3,935,604 | A | | 2/1976 | Collins | |
| 3,956,782 | A | * | 5/1976 | Morrison | 5/737 |
| 4,092,750 | A | | 6/1978 | Ellis | |
| 4,886,697 | A | * | 12/1989 | Perdelwitz et al. | 428/192 |
| 5,065,464 | A | | 11/1991 | Blanchard et al. | |
| 5,452,487 | A | | 9/1995 | Leggett | |
| D377,433 | S | * | 1/1997 | Funk et al. | D6/596 |
| 5,860,174 | A | * | 1/1999 | Failor | 5/81.1 HS |
| 5,991,945 | A | * | 11/1999 | Pang | 5/490 |
| 6,199,235 | B1 | | 3/2001 | Spahn et al. | |
| 6,256,818 | B1 | * | 7/2001 | Hughes | 5/639 |
| 6,772,764 | B2 | * | 8/2004 | Chapman | 128/870 |

(Continued)

FOREIGN PATENT DOCUMENTS

| | | | |
|---|---|---|---|
| GB | 2447406 | A | 9/2008 |
| WO | WO2006014299 | A2 | 2/2006 |
| WO | 2010082021 | A1 | 7/2010 |

OTHER PUBLICATIONS

Ecolab USA Inc., et al., PCT/US2012/051035, "Notification of Transmittal of the International Search Report and the Written Opinion of the International Searching Authority, or the Declaration", date of mailing Dec. 26, 2012.

*Primary Examiner* — Robert G Santos
*Assistant Examiner* — Myles Throop
(74) *Attorney, Agent, or Firm* — McKee, Voorhees & Sease, PLC

(57) ABSTRACT

A cover 10 for keeping an air assisted patient transfer mattress sanitary is disclosed. The cover includes generally a top panel 12 connected to a bottom panel 14. The cover 10 includes at least one opening 24 to allow a mattress, such as an air assisted patient transfer mattress to be inserted and removed. The bottom panel 14 includes air passing means to pass air through from an air assisted patient transfer mattress onto a supporting surface.

13 Claims, 8 Drawing Sheets

(56) References Cited

U.S. PATENT DOCUMENTS

| | | | | |
|---|---|---|---|---|
| 7,228,579 | B2 | 6/2007 | Tidwell | |
| 7,243,382 | B2 * | 7/2007 | Weedling et al. | 5/81.1 R |
| 7,340,785 | B2 * | 3/2008 | Weedling et al. | 5/81.1 R |
| 7,707,666 | B2 * | 5/2010 | Calkin et al. | 5/626 |
| D675,467 | S * | 2/2013 | Gil Gomez et al. | D6/606 |
| 2002/0148047 | A1 * | 10/2002 | Corzani et al. | 5/738 |
| 2002/0166168 | A1 * | 11/2002 | Weedling et al. | 5/81.1 R |
| 2005/0172406 | A1 * | 8/2005 | Post | 5/626 |
| 2006/0213010 | A1 * | 9/2006 | Davis | 5/626 |
| 2008/0244832 | A1 * | 10/2008 | Kuo | 5/638 |
| 2009/0056030 | A1 * | 3/2009 | Bolden | 5/713 |
| 2010/0088819 | A1 * | 4/2010 | Carter et al. | 5/484 |
| 2011/0035880 | A1 | 2/2011 | Cole et al. | |
| 2011/0154570 | A1 * | 6/2011 | Curos Santaeularia | 5/490 |
| 2012/0159715 | A1 * | 6/2012 | Jung et al. | 5/703 |

* cited by examiner

COVER FOR PATIENT TRANSFER DEVICES

BACKGROUND OF THE INVENTION

1. Field of the Invention

This invention relates generally to a reusable or disposable cover for a patient transfer mattress, and more particularly to a cover for use with an air assisted patient transfer mattress.

2. Description of the Prior Art

Patient transfer mattresses are being used with increasing frequency for safely transferring, repositioning and handling patients while reducing the risk of injury and increasing the patient's comfort. The mattress often comes into contact with the body and bodily fluids of the patient resulting in the mattress being contaminated. The mattress is then laundered and sanitized before being reused. Laundering, sanitizing and loss of the use of the mattress represent a significant and unnecessary expense that most businesses are not willing to bear.

It is therefore desirable to provide a disposable or reusable cover that generally encloses the patient transfer mattress, such as an air assisted patient transfer mattress, for keeping the mattress sanitary.

It is further desirable to provide a cover that keeps the mattress sanitary and does not inhibit the ease with which these mattresses are used to reposition, transfer or handle patients both safely and comfortably without the risk of injury.

SUMMARY OF THE INVENTION

In one embodiment, the invention is a cover for keeping reusable devices sanitary. The cover includes a top layer and a bottom layer connected together to form an envelope having at least one open end. The cover includes air passing means in the bottom layer to pass air from the envelope onto a supporting surface. In a preferred form, the cover is used in combination with an air assisted patient transfer device or mattress, and the bottom layer of the cover includes a plurality of patterned fenestrations that align with air release points in the underside of an air assisted patient transfer mattress.

In another embodiment, the invention is a disposable cover for keeping an air assisted patient transfer mattress sanitary. The cover includes a sleeve having a top sheet, a bottom sheet, and a pocket formed between the top and bottom sheet. The cover also includes a plurality of patterned fenestrations in the bottom sheet for passing air through onto a supporting surface from air release points in the mattress. In a preferred form, the patterned fenestrations occupy a central portion of the bottom sheet to align generally with air release points in the underside of the air assisted patient transfer mattress, and the top sheet is a laminate having an absorbent layer and an impervious layer.

In another embodiment, the invention is a reusable cover for keeping an air assisted patient transfer mattress sanitary. The cover includes a first layer terminating and lateral edges, with at least three of the lateral edges connected to a second layer to form a sleeve for housing an air assisted patient transfer mattress. Air passing means is included in one of the layers for directing air from the patient transfer mattress out of the sleeve onto a supporting surface. In a preferred form, the opposing lateral edges include a plurality of handles and a plurality of straps releasably attachable over the first or second layer.

In another embodiment, the invention is a method for keeping an air assisted patient transfer mattress sanitary. The method includes providing a cover having a top layer, a bottom layer and an open end. The bottom layer has air passing means. The method also includes the steps of inserting the air assisted patient transfer mattress into the cover through the open end and aligning the air passing means in the bottom layer with air vents in the underside of the air assisted patient transfer mattress. In a preferred form, the method also includes closing at least partially the open end to enclose the air assisted patient transfer mattress in the cover.

DETAILED DESCRIPTION OF THE PREFERRED EMBODIMENTS

FIGS. 2-8 describe exemplary features and concepts of the present invention by illustration. The intent of the preferred embodiments of the present invention is to provide features that both keep a patient transfer mattress sanitary and safe for subsequent use without laundering or cleaning, and generally encloses the mattress without impeding or preventing the mattress from operating properly and mainlining use of the mattress as a safe and comfortable way for repositioning, moving and transferring a patient.

Exemplary features and aspects of the present invention for keeping a patient transfer mattress sanitary using a cover that generally encloses the mattress are illustrated in FIGS. 2-8.

Figure 1:
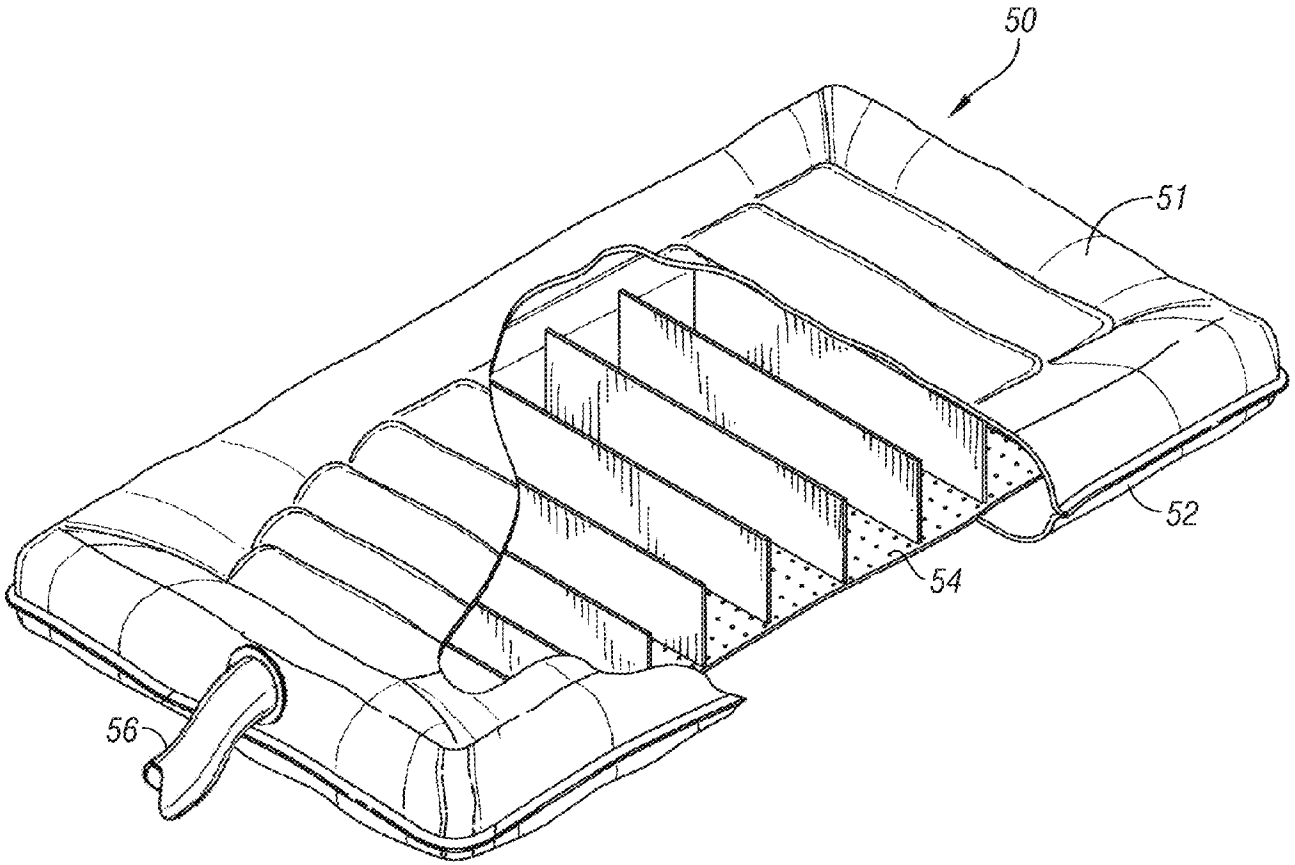
FIG. 1 (PRIOR ART)
FIG. 1 is an illustration of an air assisted patient transfer mattress of the prior art.
Figure 2:
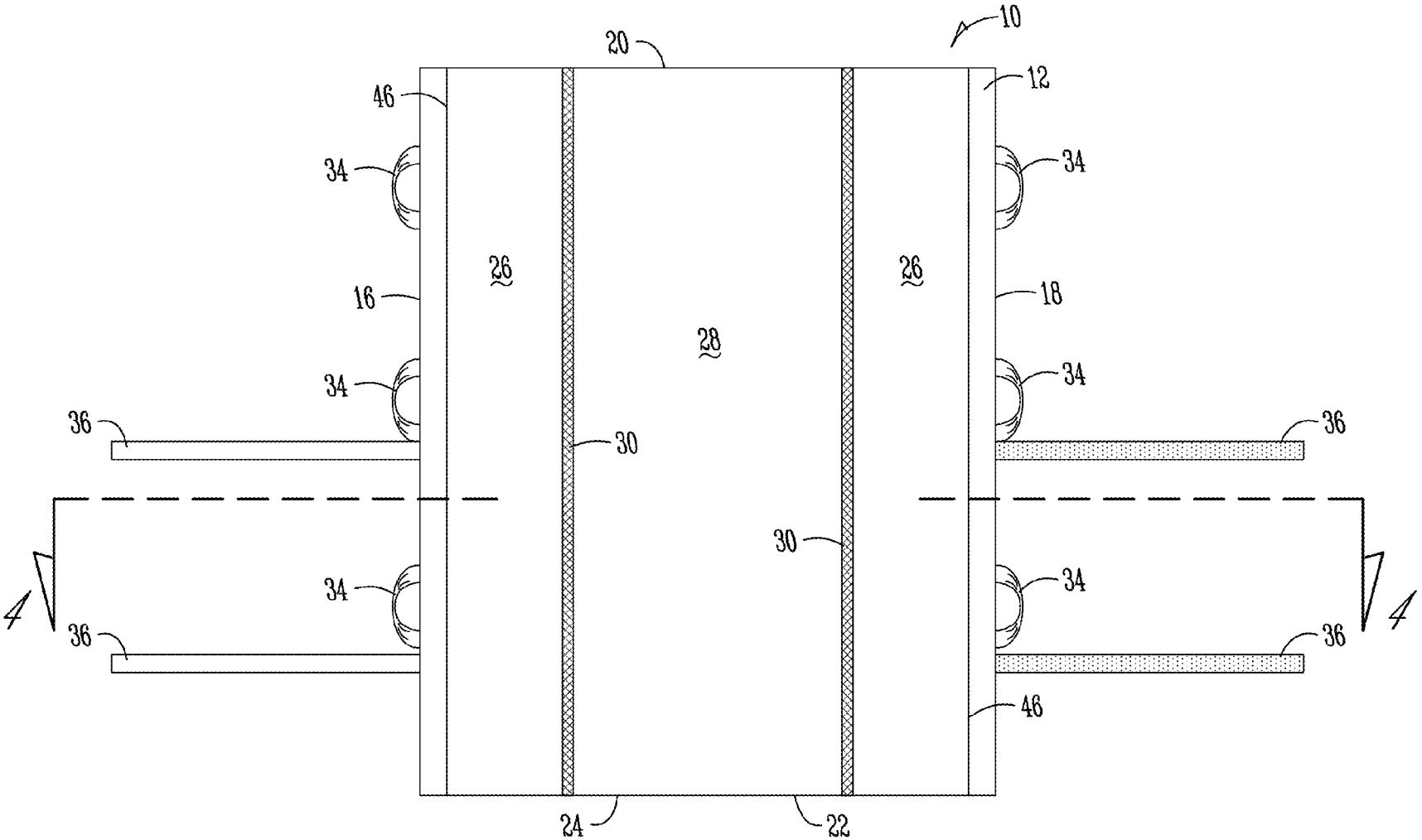
FIG. 2 is a view of the top side of an exemplary cover of the present invention.

FIG. 1 illustrates a commercially available air assisted patient transfer mattress 50. The mattress 50 includes generally a top side 51 and an opposite bottom side 52. An air supply hose 56 is connected in communication with the chamber formed between the top side 51 and the bottom side 52. Air vents 54 are included in the bottom side of the mattress 50 to allow air pumped into the mattress through the air supply hose 56 to exit the air vents 54 to create an air cushion between the bottom side 52 of the mattress 50 and a supporting surface.

The present invention provides a means for keeping a mattress, such as the commercially available mattress 50 illustrated in FIG. 1, sanitary without inhibiting the functionality of the mattress 50 described above. Exemplary embodiments of a cover accomplishing at least the aforementioned objectives are illustrated in FIGS. 2-7.

Figure 3:
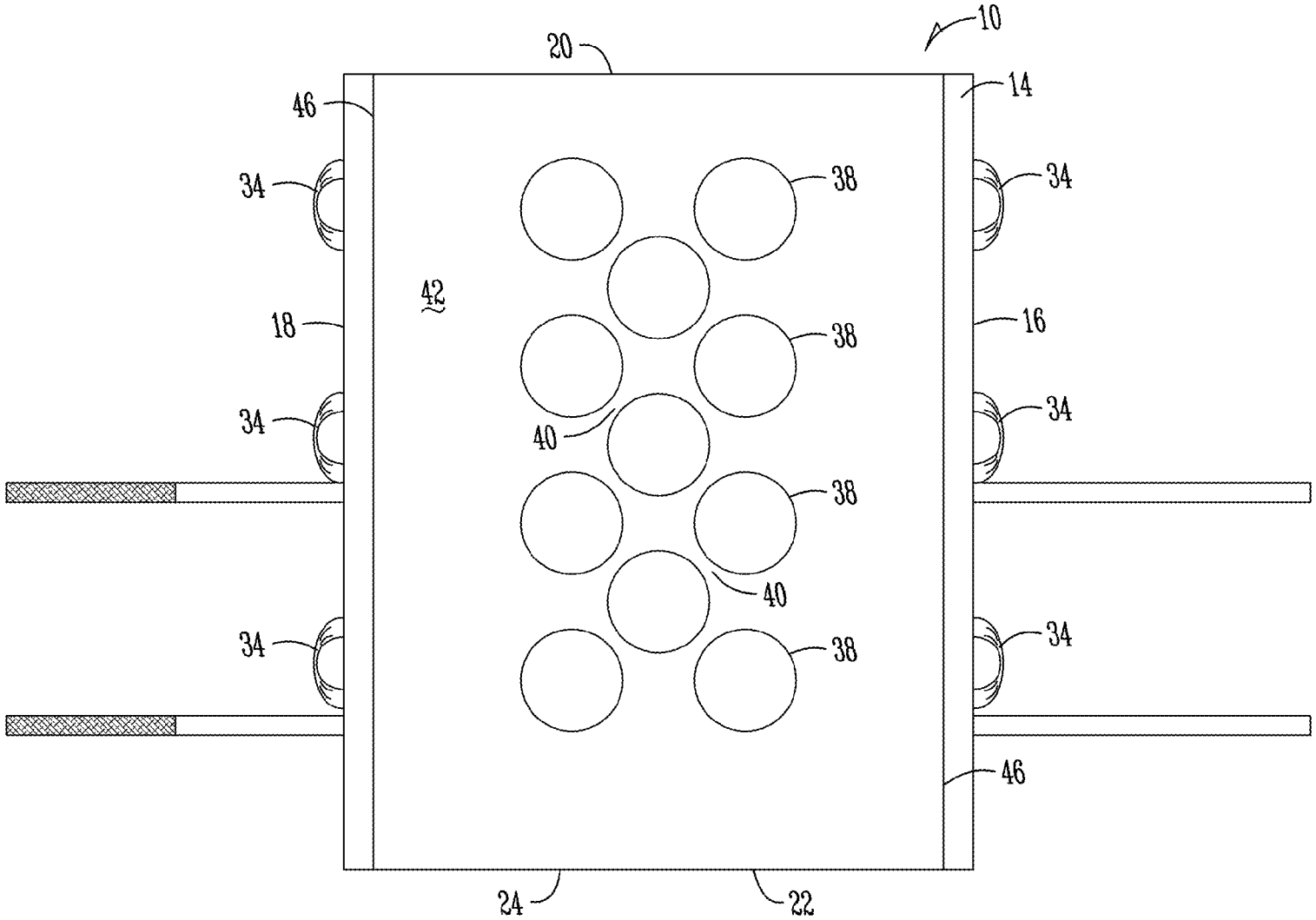
FIG. 3 is a view of the bottom side of the cover illustrated in FIG. 2.
Figure 4:
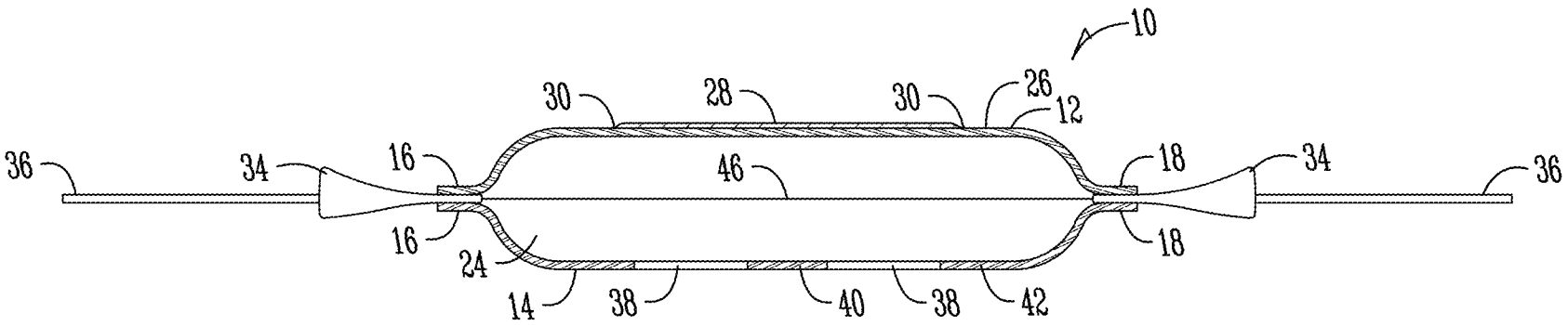
FIG. 4 is an end view taken along line 4-4 in FIG. 2.

FIGS. 2-8 illustrate exemplary embodiments of a cover 10 of the present invention for use in combination with preferably a patient transfer mattress, such as an air assisted patient transfer mattress. The illustrated cover 10 could also be used for other patient transfer mattresses where it is important to keep the mattress sanitary, and limit or completely do away with the requirement of laundering or professionally sanitizing the mattress so it can be used multiple times before discarding. The cover 10 includes generally a top panel 12 and a bottom panel 14. The top panel 12 is generally for covering the top side of a mattress, such as the top side 51 of mattress 50 illustrated in FIG. 1. Similarly, the bottom panel 14 is generally for covering the bottom side 52 of a mattress, such as the bottom side 52 of the mattress 50 illustrated in FIG. 1. The top panel 12 and the bottom panel 14 are secured together at least at a pair of opposite lateral edges, preferably lateral edges 16 and 18 as best illustrated in FIG. 4. At least a pair of lateral edges of the top panel 12 and bottom panel 14 are connected together to form generally an outer peripheral edge of the cover 10. Additionally, lateral edge 20 of the top panel 12 and the bottom panel 14 are connected together to form a strong interface or seam 46. At least one lateral edge of the top panel 12 and bottom panel 14 is open for inserting a mattress into the cover 10. In one embodiment, a mattress is inserted into the cover 10 through an opening 24 occupying space between the lateral edge 22 of the top panel 12 and the bottom panel 14.

The edges of the top and bottom panel may be sewn together or laminated together mechanically to form a strong interface or seam 46 generally between edges of the top panel 12 and bottom panel 14. The opening 24 spaced between the lateral edges 22 of the top panel 12 and bottom panel 14 may be closable by closing means such as a zipper, Velcro, a zip seal, an adhesive, or other reclosable type openings. The opening 24 may be a single-use type opening that allows a mattress to be sealed inside the cover 10 and is configured for being reopened so that the mattress can be removed. Preferably, the cover 10 includes an opening 24 for removably inserting a mattress into the cover 10 and to allow for an air supply hose, such as the air supply hose 56 illustrated in FIG. 1, to pass into the cover 10 for supplying air to the mattress. The opening 24 may be fully closable or partially closable, and may include a geometry that accounts for the passage of an air supply hose through the cover 10. Lateral edges 16 and/or 18 may be figured with an opening for receiving an air supply hose, such as for example where the air supply house is on the side and not the bottom of the mattress. The opening 24 may also be configured The geometry may be configured to seal generally about the outer surface of the air supply hose to allow the opening to be generally closed when the cover and mattress are in use. The cover 10 may also be configured to have excess length so that the lateral edges 22 of the top panel 12 and bottom panel 14 drape over and cover the end, and bottom and top edges of the end of the mattress to keep it sanitary.

Handles 34 are also configured into the cover 10 preferably at the lateral edges 16 and 18. The handles 34 may be a strap, cord, woven material, or non-woven material. The handles 34 are joined to the cover by stitching or by laminating one or more layers of the cover and the handle together to create a strong bond between the handle and the cover as best illustrated in FIG. 4. In one embodiment, the handles are stitched between the lateral edges of the top panel 12 and bottom panel 14 to create a strong interface between the handles 34 and the cover 10. In another embodiment, the handles 34 are fastened or secured to the bottom panel 14 to position the handles 34 in a location that is easily accessible and reachable when the cover is in use. The cover also includes one or more straps 36 that are secured together over the top panel 12 by attachment means such as Velcro as illustrated in FIG. 4. The straps 36 allow the cover 10 and a mattress inside the cover to be securely fastened to a patient resting on the top panel 12 of the cover 10. Using the handles 34, a patient can be transferred from one supporting surface to another while resting on the cover 10 housing a mattress.

To keep a mattress within the cover sanitary, the cover 10 generally encloses or envelopes the mattress similar to a pillow and pillow case. Thus, bodily fluids and other contaminating materials are kept from getting onto or having access to a mattress enclosed within the cover 10. Both the top panel 12 and bottom panel 14 are configured to keep a mattress enclosed within the cover 10 sanitary. According to one aspect of the present invention, the top panel 12 is a laminate type material having an absorbent layer and an impervious layer. For example, the first material 26 of the top panel 12 may be an impervious layer such as a thermoplastic. The bottom panel 14 may also be a thermoplastic and joined to the first material 26 of the top panel 12 by mechanically laminating the two layers together. One example of a thermoplastic polymer suitable for constructing the first material 26 of the top panel 12 is polyethylene terephthalate (PET). In the case where the bottom panel 14 is also a thermoplastic polymer, the bottom panel may be constructed of PET. The first material 26 of the top panel 12 provides generally an impervious layer for protecting a mattress within the cover 10 from bodily fluids and other contaminating materials to keep the mattress sanitary. Other non-woven materials are also suitable for use as a first material 26 for the top panel 12. A non-woven material may also be used for the bottom panel 14. The top panel 12 may also include an absorbent layer. For example, the top panel 12 may include a second material 28 being generally absorbent in nature. The second material 28 of the top panel 14 may include an absorbent polymer or other highly absorbent material that is preferably disposable. The second material 28 is joined to the first material 26 of the top panel 12 by a seam 30. The second material 28 may occupy a majority of the top panel 12 or only a smaller portion of the top panel 12 directly underneath where a patient would lie. The second material 28 may include sections that are highly absorbent depending upon the position of these sections relative to where the patient would lie and/or where there is a greater possibility of exposure to bodily fluids or other contaminating materials.

Figure 5:
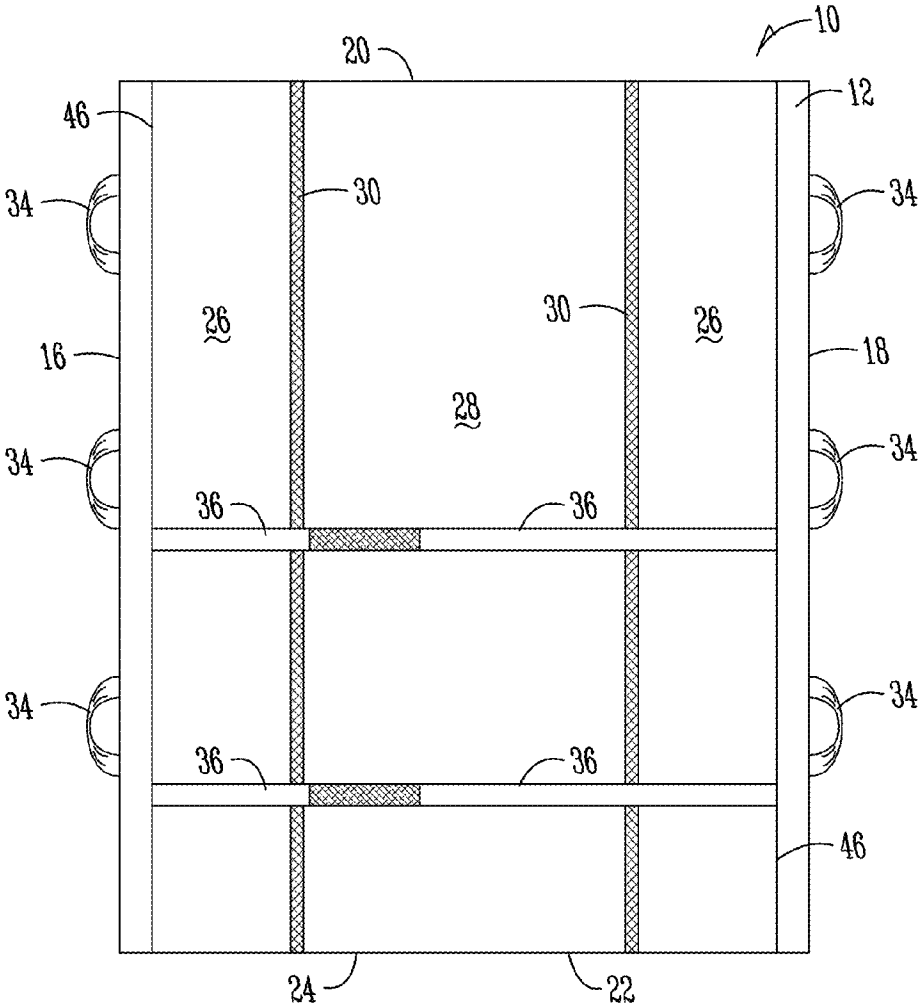
FIG. 5 is a view of the top side of a cover according to an exemplary embodiment of the present invention.
Figure 6:
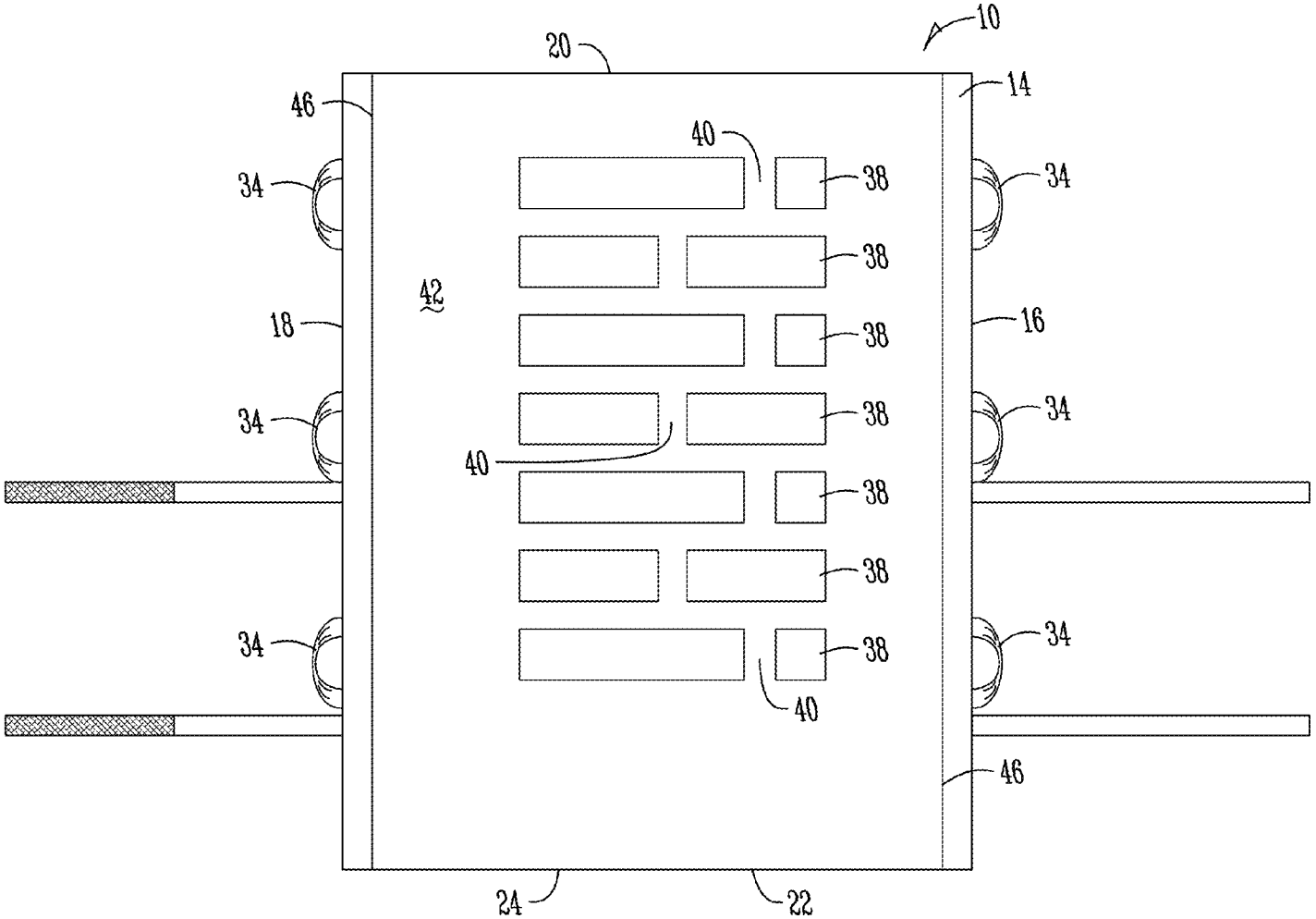
FIG. 6 is a view of the bottom side of the cover illustrated in FIG. 5.
Figure 7:
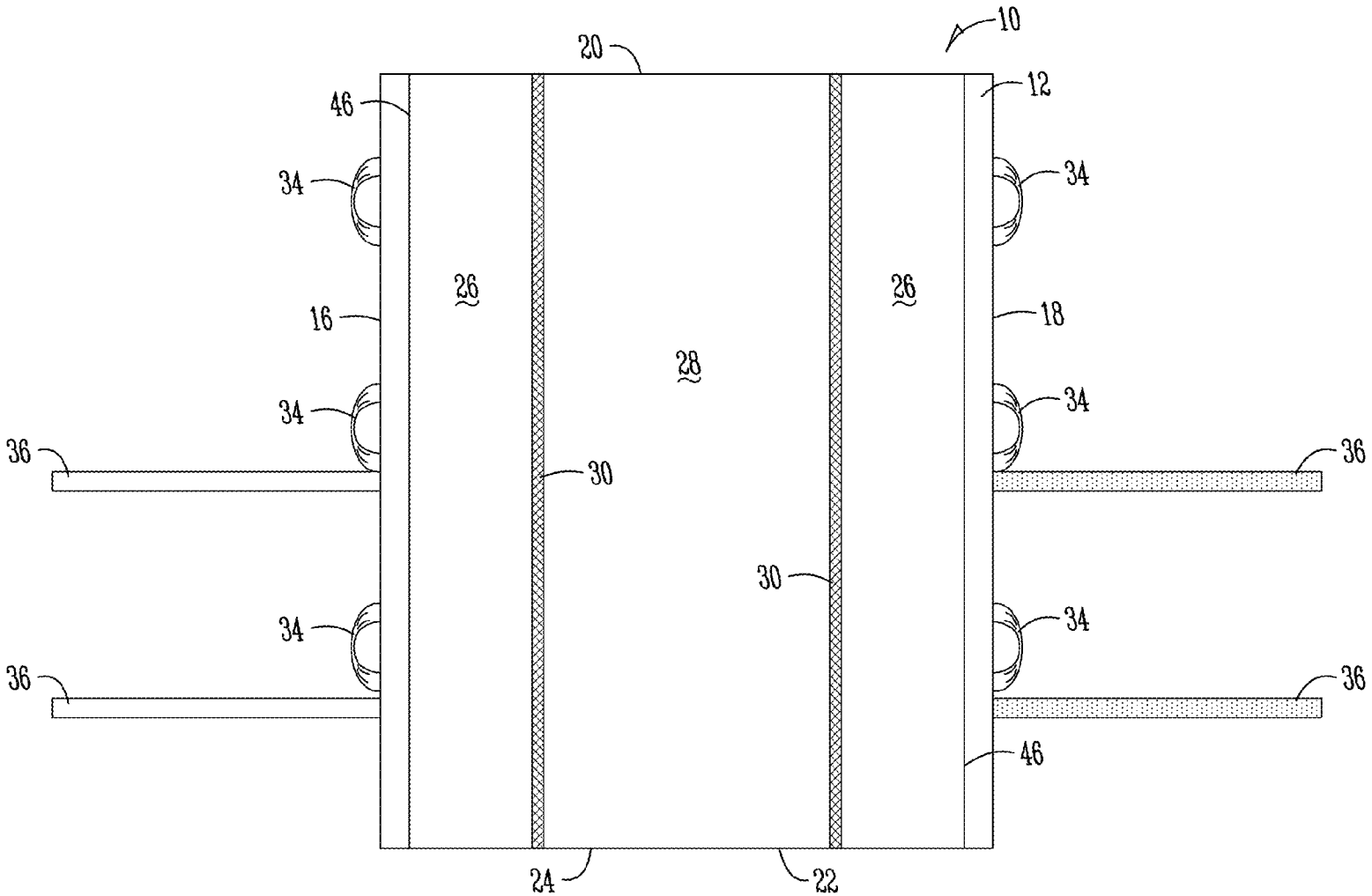
FIG. 7 is a view of the top side of an exemplary cover of the present invention.
Figure 8:
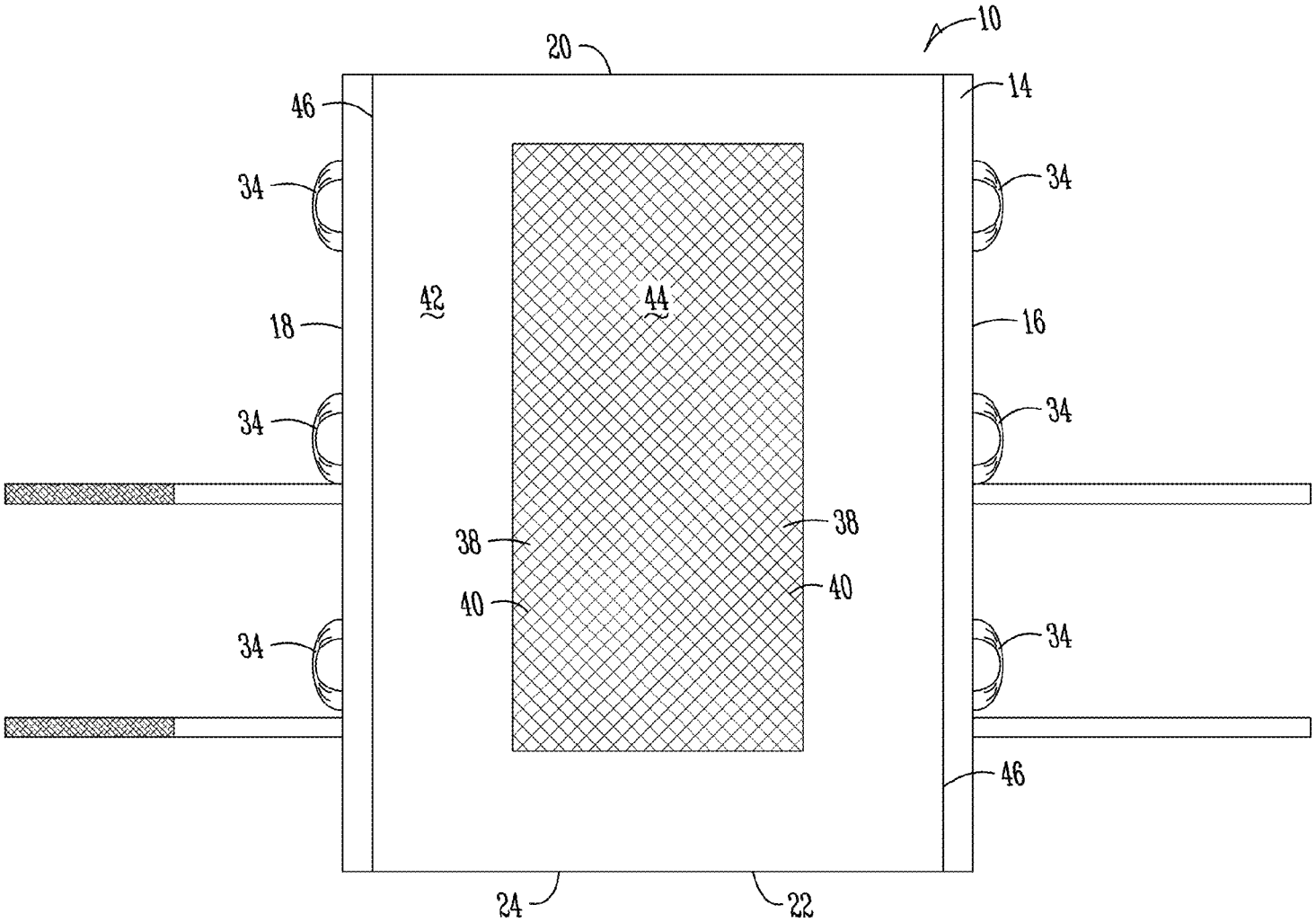
FIG. 8 is a view of the bottom side of the cover illustrated in FIG. 7.

FIGS. 3, 5 and 7 illustrate various embodiments of the bottom panel 14 of the cover 10 of the present invention. As indicated previously, the bottom panel 14 is configured to cover generally a bottom side or underside of a mattress, such as the bottom or underside 52 of the mattress illustrated in FIG. 1. Commercial patient transfer mattresses that are air assisted include air vents in the bottom side portion of the mattress to allow air being pumped into the mattress to escape through the vent holes and to create an air cushion between the bottom side of the air mattress and the supporting surface to reduce the friction and allow for ease of transfer of a patient resting on the mattress. For example, as illustrated in FIG. 1, air vents 54 allow air being pumped into the mattress through air supply hose 56 to vent from the bottom side 52 of the mattress onto a supporting surface to create an air cushion for ease in moving or transferring a patient on the mattress from one supporting surface to another. In keeping with the objectives of the present invention, the bottom panel 14 of the cover 10 includes a plurality of fenestrations 38. The plurality of fenestrations 38 may be patterned so as to occupy a majority of the space comprising vents of an air mattress enclosed within the cover 10. The plurality of fenestrations 38 are also configured or patterned to maintain a webbing 40 of sufficient strength between the fenestrations 38 so as to maintain the structural integrity of the cover 10. Each fenestration 38 is configured to pass through the entirety of the bottom panel 14. In this manner, air venting from the air vents in a mattress enclosed within the cover 10 is permitted to pass through the fenestrations and onto the supporting surface to create an air cushion for ease in transferring a patient resting on the top panel 12 of the cover 10. The plurality of fenestrations 38 may include a number of geometry types. For example, fenestrations 38 may be generally circular or oval in shape as illustrated in FIG. 3. The fenestrations may also be generally rectangular or square in shape as illustrated in FIG. 5. The fenestrations in the bottom panel 14 may comprise a thinning in the material making up the bottom panel 14 or a screen-like material allowing for passage of air from a mattress enclosed within the cover 10 onto a supporting surface. The size of the meshing may be controlled so as to create a strong webbing 40 to maintain the structural integrity of the bottom panel 14 and to prevent the cover from failing when a tugging force is applied to the handles 34. The size of the mesh or the amount of thinning of the bottom panel 14 may be controlled so as to permit and not prohibit or impede the flow of air from a mattress enclosed within the cover 10 onto a supporting surface. Other geometries than those illustrated in the figures are also contemplated. For example, trapezoidal, octagonal, hexagonal, or other geometries may be used and patterned so as to create a strong webbing 40 and a sufficient number of openings to permit air from a mattress enclosed within the cover 10 to vent onto a supporting surface. The bottom panel 14 as discussed previously may include a first material 42 such as a non-woven material. The first material 42 of the bottom panel 14 may also be a thermoplastic material such as PET. The bottom panel 14 may also include a second material (not shown) for strengthening the webbing 40 or providing an absorbent feature or characteristic to the bottom panel to prevent the mattress enclosed within the cover from becoming contaminated by passage of fluids or other contaminating materials through the fenestrations 38. A second material (not shown) may be fastened, secured or bound to the first material 42 of the bottom panel 14 by stitching, adhesive means, or mechanical lamination. The space in the bottom panel 14 occupied by the pattern of fenestrations 38 may further comprise a second material secured to, fastened or bound to the first material 42 of the bottom panel 14. The bottom panel 42 preferably includes an impervious layer or material to keep the mattress enclosed within the cover 10 sanitary. The bottom panel 14 may also include an absorbent layer similar to the top panel 12 as described above. The pattern of the fenestrations 38 is preferably patterned to correspond with the location of the air vents in an air assisted patient transfer mattress, such as the location of the vents 54 in mattress 50 illustrated in FIG. 1. The cover 10 may be disposed after each use or laundered and re-used depending upon the type of materials used to construct the cover 10, specifically the top panel 12 and bottom panel 14.

While the cover 10 hereinbefore described is effectively adapted to fulfill the aforementioned objectives, it is to be understood that the invention is not intended to be limited to the specific preferred embodiments of the aspects disclosed and set forth above. Rather, it is to be taken as including all reasonable equivalents to the subject matter of the appended claims.

What is claimed is:

1. A cover for keeping reusable devices sanitary comprising:

a top layer and a bottom layer connected together to form an envelope having at least one open end;

air passing centrally located means in the bottom layer to pass air through from the envelope onto a surface supporting the device;

wherein the air passing means comprises a plurality of fenestrations in the bottom layer;

wherein the plurality of fenestrations are patterned to occupy a majority of space comprising air release points in an underside of an air assisted patient transfer mattress;

a plurality of handles secured to the cover;

a plurality of straps secured to the cover;

wherein the handles and straps are secured between the top layer and the bottom layer.

2. The cover of claim 1 in combination with an air assisted patient transfer mattress.

3. The cover of claim 1 wherein the plurality of fenestrations comprises a screen and a webbing forming the bottom layer, wherein the screen and the webbing are configured to maintain the structural integrity of the bottom layer when a tugging force is applied.

4. A disposable cover for keeping an air assisted patient transfer mattress sanitary, comprising:

a sleeve having a top sheet, a bottom sheet, and a pocket formed between the top and bottom sheet;

a plurality of patterned fenestrations in the bottom sheet for passing air through onto a supporting surface from air release points in the patient transfer mattress;

wherein the plurality of patterned fenestrations occupy a central portion of the bottom sheet and align with the air release points in an underside of the patient transfer mattress;

a plurality of handles secured to the cover;

a plurality of straps secured to the cover; and wherein the plurality of handles and straps are secured between the top sheet and the bottom sheet at one or more lateral edges of the sleeve.

5. The cover of claim 4 wherein the top sheet comprises a laminate having an absorbent layer and an impervious layer.

6. The cover of claim 5 wherein the inner impervious material comprises a thermoplastic.

7. The cover of claim 4 wherein the top and bottom sheet comprise a non-woven material.

8. The cover of claim 4 wherein the sleeve includes a closeable opening.

9. A reusable cover for keeping an air assisted patient transfer mattress sanitary, comprising:

a first layer terminating in lateral edges, at least three of the lateral edges connected to a second layer to form a sleeve for housing an air assisted patient transfer mattress;

air passing means in one of the layers for directing air from the patient transfer mattress out of the sleeve onto a supporting surface;

wherein the air passing means comprises a pattern of fenestrations in a portion of the first or second layer;

further wherein the pattern of fenestrations is patterned to correspond with a location of air vents in the air assisted patient transfer mattress;

a plurality of straps secured to the cover between the first layer and the second layer; and a plurality of handles secured to the cover between the first layer and the second layer.

10. The cover of claim 9 wherein the plurality of straps are releasably attachable over the first or second layer.

11. A method for keeping an air assisted patient transfer mattress sanitary, comprising:

providing a cover having a top layer, a bottom layer and an open end, the bottom layer having air passing means comprising a plurality of fenestrations the top layer and bottom layer being secured together at a lateral edge, a plurality of straps secured to the cover between the top layer and the bottom layer and a plurality of handles secured to the cover between the top layer and the bottom layer;

inserting the air assisted patient transfer mattress into the cover through the open end; and aligning the plurality of fenestrations in the bottom layer with air vents in the underside of the air assisted patient transfer mattress;

wherein the plurality of fenestrations are patterned to occupy a majority of space comprising the air vents in an underside of the air assisted patient transfer mattress.

12. The method of claim 11 wherein the cover is moved with the air assisted patient transfer mattress.

13. The method of claim 11 further comprising closing at least partially the open end to enclose the air assisted patient transfer mattress in the cover.

* * * * *